US011456127B2

(12) United States Patent
Osako et al.

(10) Patent No.: US 11,456,127 B2
(45) Date of Patent: Sep. 27, 2022

(54) SWITCH DEVICE

(71) Applicant: ALPS ALPINE CO., LTD., Tokyo (JP)

(72) Inventors: Hajime Osako, Vastra Frolunda (SE); Kazuma Takeo, Miyagi (JP); Kenji Kawano, Miyagi (JP)

(73) Assignee: ALPS ALPINE CO., LTD., Tokyo (JP)

( * ) Notice: Subject to any disclaimer, the term of this patent is extended or adjusted under 35 U.S.C. 154(b) by 0 days.

(21) Appl. No.: 17/249,840

(22) Filed: Mar. 16, 2021

(65) Prior Publication Data

US 2021/0202192 A1 Jul. 1, 2021

Related U.S. Application Data

(63) Continuation of application No. PCT/JP2019/009772, filed on Mar. 11, 2019.

(30) Foreign Application Priority Data

Sep. 18, 2018 (JP) ..... JP2018-173997

(51) Int. Cl.
*H01H 13/04* (2006.01)
*H01H 13/14* (2006.01)
*H01H 13/10* (2006.01)

(52) U.S. Cl.
CPC ..... *H01H 13/14* (2013.01); *H01H 13/04* (2013.01); *H01H 13/10* (2013.01)

(58) Field of Classification Search
CPC ..... H01H 3/125; H01H 13/705; H01H 13/14; H01H 13/04; H01H 13/10; H01H 13/70;
(Continued)

(56) References Cited

U.S. PATENT DOCUMENTS 6,396,923 B1 5/2002 Kitamura et al.
9,006,590 B2 * 4/2015 Bailey ..... H01H 13/86 200/302.2
9,362,066 B2 6/2016 Izawa

FOREIGN PATENT DOCUMENTS

CN 107221470 9/2017
JP H02-101431 U 8/1990
(Continued)

OTHER PUBLICATIONS

International Search Report for PCT/JP2019/009772 dated Jun. 4, 2019.

*Primary Examiner* — Ahmed M Saeed
(74) *Attorney, Agent, or Firm* — IPUSA, PLLC

(57) ABSTRACT

A switch device includes a substrate having one surface and another surface; a switch disposed on the one surface of the substrate and configured to be pressed; a first housing; a second housing; and a pin member. An internal space is formed by the first housing and the second housing, and the substrate is disposed in the internal space. The first housing has an opening through which at least a part of the pin member is inserted into the internal space. The second housing includes a support portion that supports the another surface of the substrate. When the pin member is inserted into the internal space through the opening, the pin member presses the support portion against the another surface of the substrate so as to cause the support portion to support the another surface of the substrate.

7 Claims, 16 Drawing Sheets

(58) Field of Classification Search
CPC ..... H01H 13/704; H01H 13/7065; H01H 13/7006; H01H 13/7057; H01H 13/78; H01H 13/79; H01H 13/52; H01H 13/703; H01H 13/507
See application file for complete search history.

(56) References Cited

FOREIGN PATENT DOCUMENTS

| | | |
|---|---|---|
| JP | H07-272152 | 10/1995 |
| JP | 2000-151136 | 5/2000 |
| JP | 2014-175180 | 9/2014 |
| KR | 10-0810112 | 3/2008 |

* cited by examiner

SWITCH DEVICE

CROSS-REFERENCE TO RELATED APPLICATIONS

This application is a continuation of International Application No. PCT/JP2019/009772, filed on Mar. 11, 2019 and designating the U.S., which claims priority to Japanese Patent Application No. 2018-173997, filed on Sep. 18, 2018. The contents of these applications are incorporated herein by reference in their entirety.

BACKGROUND OF THE INVENTION

1. Field of the Invention

The disclosures herein relate to a switch device.

2. Description of the Related Art

Push-button switches are known as components capable of controlling electronic devices and the like. Such a push-button switch is attached to a substrate and can be operated by pressing a pressing portion of the push-button switch from the above.

In a switch device that utilizes such a push-button switch, the push-button switch is attached to a substrate, and the substrate is covered by and supported within a housing. In the switch device having this configuration, a pressing portion of the push-button switch is pressed directly or through a pressing member by an operator. At this time, if the substrate is moved or deflected, the push-button switch may be unable to be actually turned on even if the push-button switch seems to be turned on. Further, a reduction in the size and cost of the switch device is desired.

RELATED-ART DOCUMENTS

Patent Documents

Patent Document 1: Japanese Laid-Open Patent Publication No. 2014-175180

SUMMARY OF THE INVENTION

It is desirable to provide a small and inexpensive switch device in which a switch can be securely turned on without a substrate being moved or deflected.

According to an aspect of an embodiment, a switch device includes a substrate having one surface and another surface; a switch disposed on the one surface of the substrate and configured to be pressed; a first housing; a second housing; and a pin member. An internal space is formed by the first housing and the second housing, and the substrate is disposed in the internal space. The first housing has an opening through which at least a part of the pin member is inserted into the internal space. The second housing includes a support portion that supports the another surface of the substrate. When the pin member is inserted into the internal space through the opening, the pin member presses the support portion against the another surface of the substrate so as to cause the support portion to support the another surface of the substrate.

BRIEF DESCRIPTION OF THE DRAWINGS

Other objects and further features of the present invention will be apparent from the following detailed description when read in conjunction with the accompanying drawings, in which.

DESCRIPTION OF THE EMBODIMENTS

Figure 1:
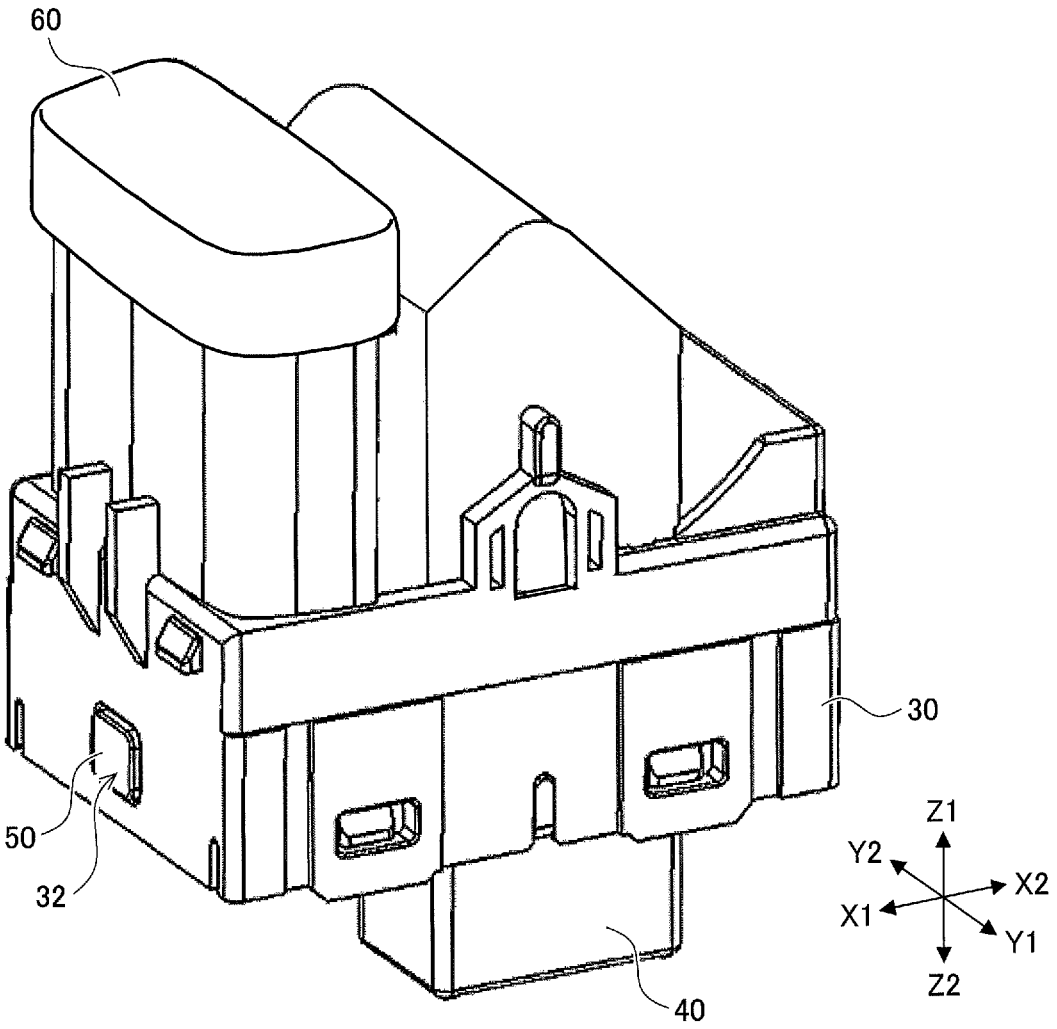
FIG. 1 is a perspective view of a switch device according to an embodiment.

According to at least one embodiment, a small and inexpensive switch device, in which a push-button switch is able to be securely turned on by pressing a pressing portion of the push-button switch, can be provided.

In the following, embodiments will be described. The same members are denoted by the same reference numerals, and a description thereof will not be repeated. Further, in the present application, an X1-X2 direction, a Y1-Y2 direction, and a Z1-Z2 direction are mutually perpendicular directions. Further, a plane including the X1-X2 direction and the Y1-Y2 direction is referred to as a XY-plane, a plane including the Y1-Y2 direction and the Z1-Z2 direction is referred to as a YZ-plane, and a plane including the Z1-Z2 direction and the X1-X2 direction is referred to as a ZX-plane.

In a switch device in which a push-button switch is mounted on a substrate and the substrate is disposed within a housing, if the substrate is moved or deflected when a pressing portion of the push-button switch is pressed by an operator, the push-button switch may be unable to be actually turned on even if the push-button switch seems to be turned on.

For the above reasons, the substrate on which the push-button switch is mounted needs to be securely fixed within the housing. However, in order to securely fix the substrate, various components may be required in general. In addition, the shape of the switch device may be complicated and the size of the switch device may be increased. As a result, it may take time and effort to assemble the switch device, thus resulting in an increase in cost.

In view of the above, it is desirable to provide a small and inexpensive switch device that includes a substrate and a push-button switch mounted on the substrate, and in which the substrate can be securely fixed at a desired position within a housing.

(Switch Device)

Figure 2:
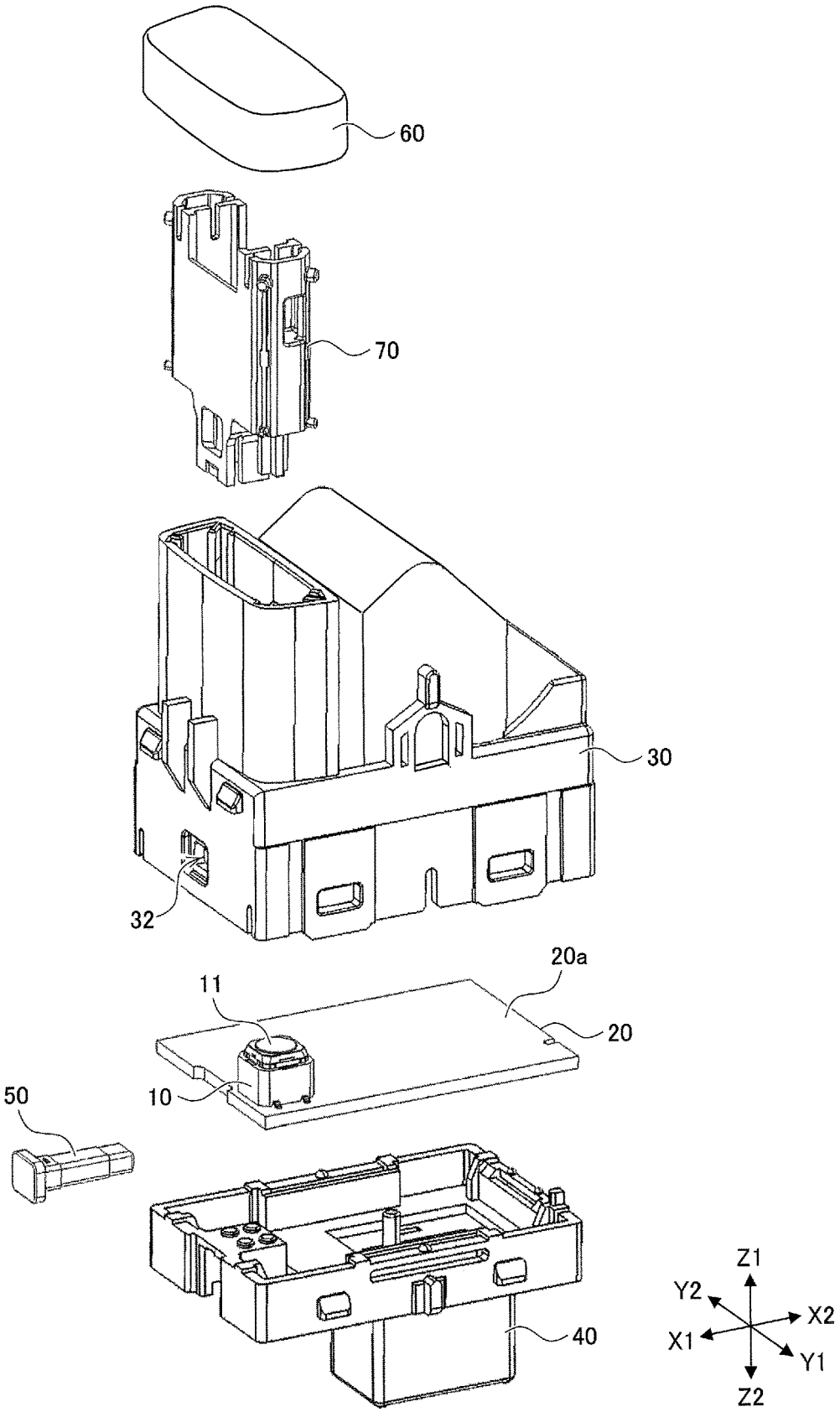
FIG. 2 is an exploded perspective view of the switch device according to the embodiment.

A switch device according to an embodiment of the present invention will be described. As illustrated in FIG. 1 and FIG. 2, the switch device according to the embodiment includes a substrate 20, a push-button switch 10 (an example of a switch that is configured to be pressed) mounted on the substrate 20, an upper housing 30, a lower housing 40, a pin member 50, a pressing member 60, and a slider 70. FIG. 1 is a perspective view of the switch device according to the embodiment. FIG. 2 is an exploded perspective view of the switch device according to the embodiment. As used herein, the upper housing 30 may be referred to as a first housing, and the lower housing 40 may be referred to as a second housing.

In the switch device according to the present embodiment, the substrate 20, on which the push-button switch 10 is mounted, is disposed and housed in an internal space surrounded by the upper housing 30 and the lower housing 40. The upper housing 30 covers one surface 20*a* on the Z1 side, which is the upper side, of the substrate 20, and the lower housing 40 covers the other surface on the Z2 side, which is the lower side, of the substrate 20. The push-button switch 10 is attached to the one surface 20*a* on the Z1 side of the substrate 20. The slider 70 is provided within the upper housing 30 and is situated on the push-button switch 10. Further, the pressing member 60 extending to the outside of the upper housing 30 is provided on the slider 70.

In the switch device according to the present embodiment, pressing the pressing member 60 being pressed down in the Z2 direction causes the end portion on the Z1 side of the slider 70 to be pressed in the Z2 direction. As a result, the entire slider 70 is moved in the Z2 direction, and a pressing portion 11 of the push-button switch 10 is pressed by the end portion of the Z2 side of the slider 70, thereby turning the push-button switch 10 on.

In the following description, the switch device according to the present embodiment includes the pressing member 60 and the slider 70; however, the switch device according to the present embodiment does not necessarily include the pressing member 60 and the slider 70, and the pressing portion 11 of the push-button switch 10 may be configured to be directly pressed.

(Components)

Figure 3:
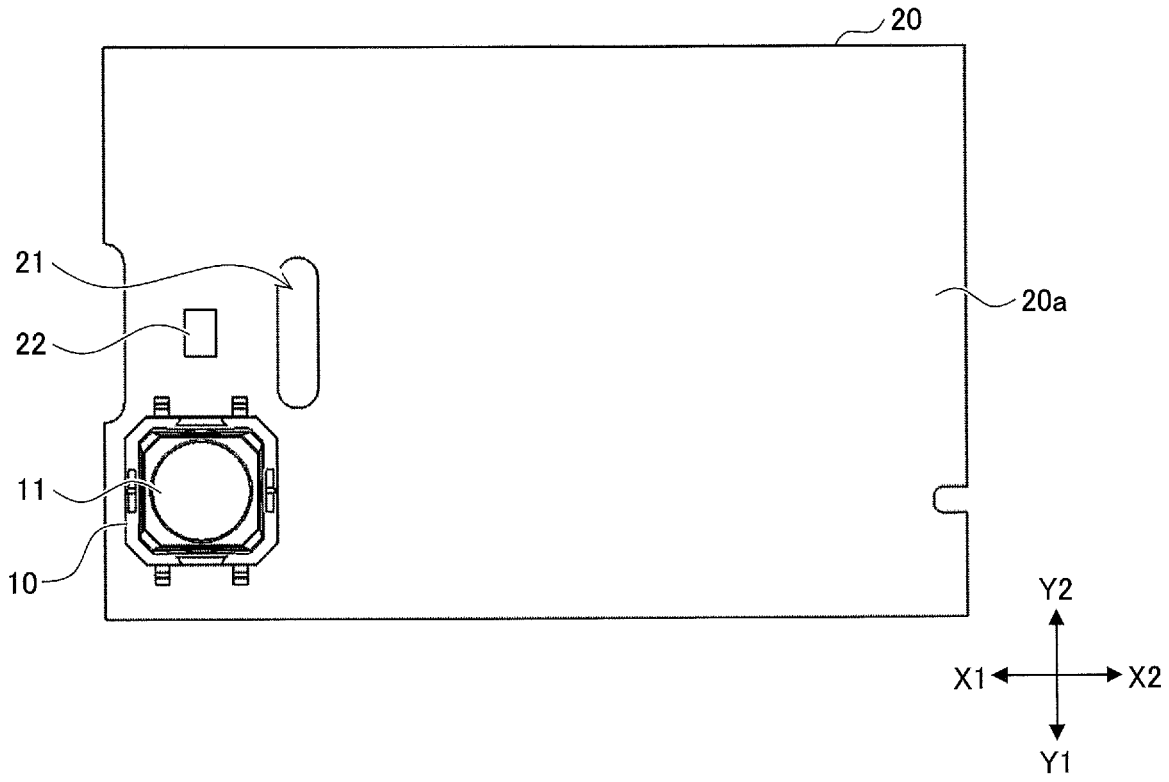
FIG. 3 is a top view of a substrate to which a switch is attached according to the embodiment.
Figure 4:
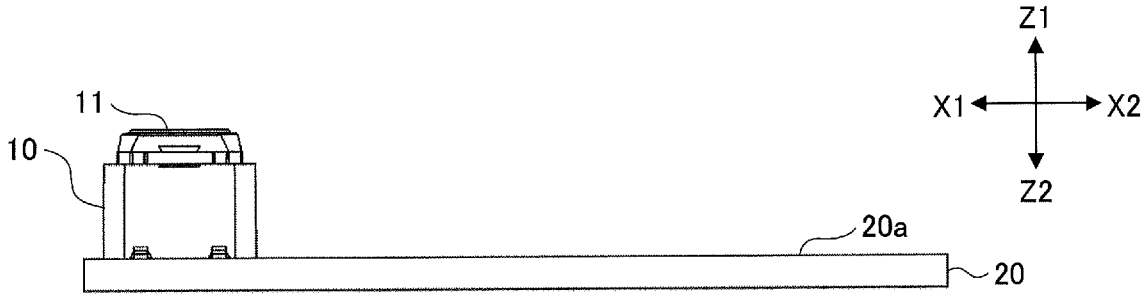
FIG. 4 is a side view of the substrate to which the switch is attached according to the embodiment.
Figure 5:
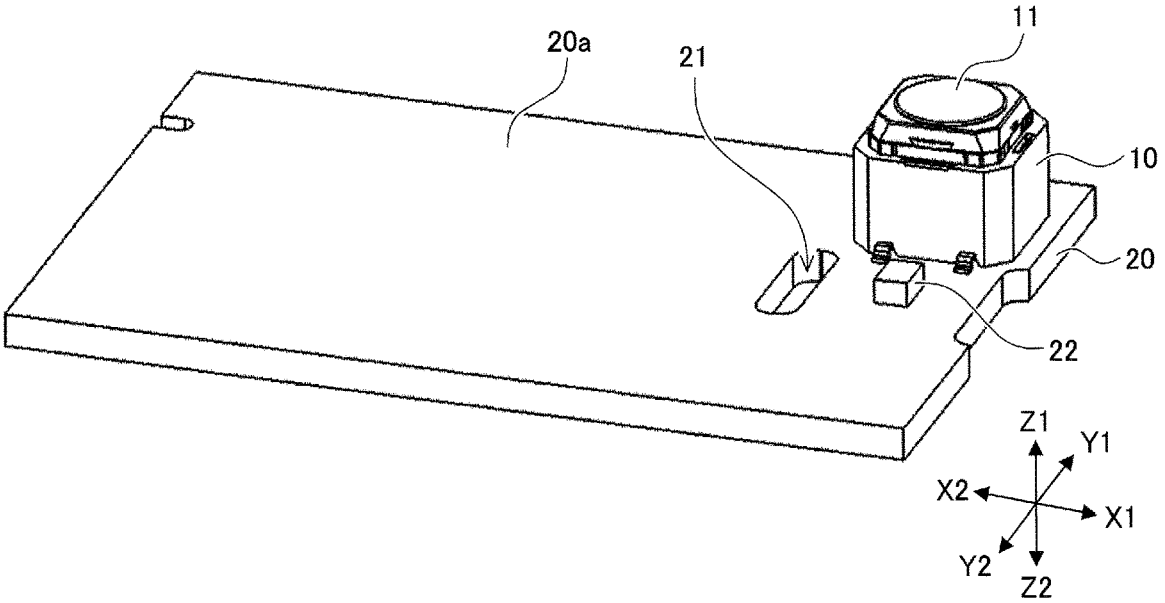
FIG. 5 is a perspective view of the substrate to which the switch is attached according to the embodiment.

Next, the push-button switch 10 and the substrate 20 will be described with reference to FIG. 3 through FIG. 5. FIG. 3 is a top view of the substrate 20 to which the push-button switch 10 is attached. FIG. 4 is a side view of the substrate 20 to which the push-button switch 10 is attached. FIG. 5 is a perspective view of the substrate 20 to which the push-button switch 10 is attached. The push-button switch 10 is attached to the one surface 20*a* on the X1 side of the substrate 20. The pressing portion 11 is provided on the Z1 side of the push-button switch 10. The push-button switch 10 can be turned on by pressing the pressing portion 11 of the push-button switch 10 in the Z2 direction. The substrate 20 is formed of an insulating material such as a glass epoxy resin, and has an approximately rectangular shape. Further, a through-hole 21 is formed in the substrate 20 in the vicinity of the push-button switch 10. In addition, a light emitting element 22 such as a light emitting diode (LED) is mounted on the one surface 20*a* of the substrate 20 in the vicinity of the push-button switch 10.

Figure 6:
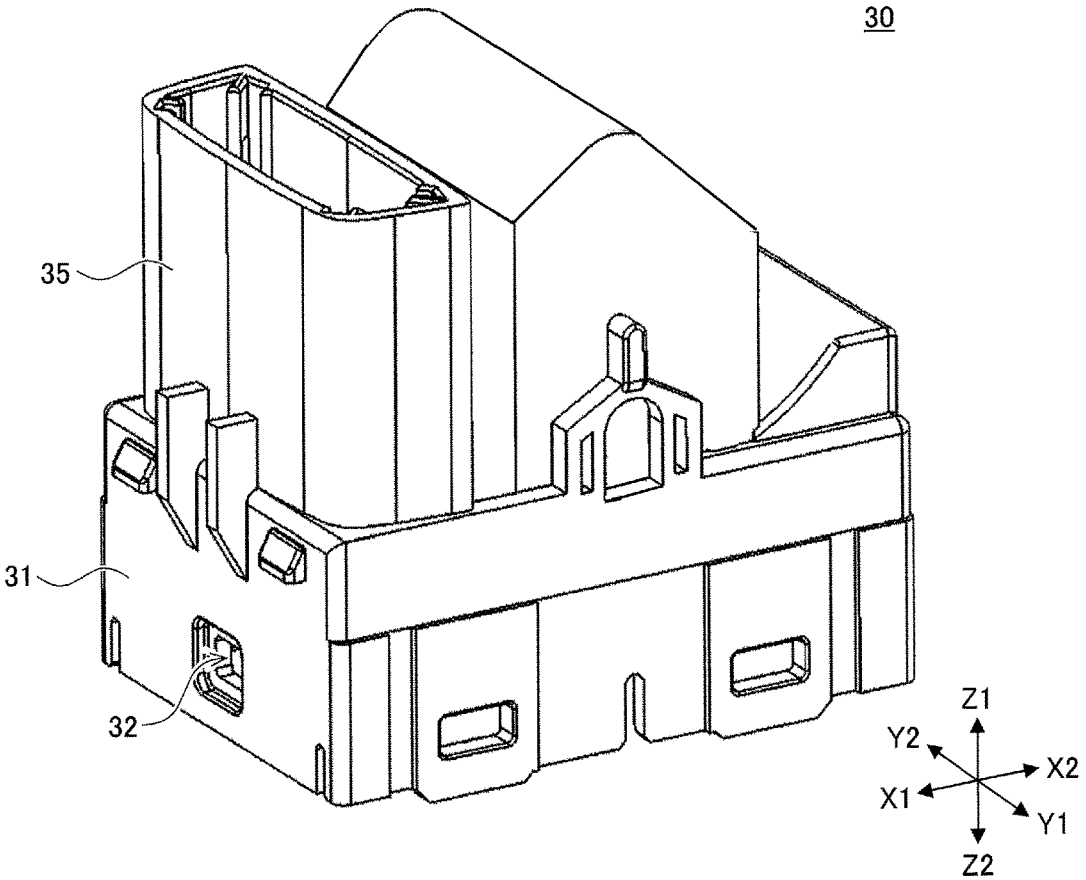
FIG. 6 is a perspective view (1) of an upper housing according to the embodiment.
Figure 7:
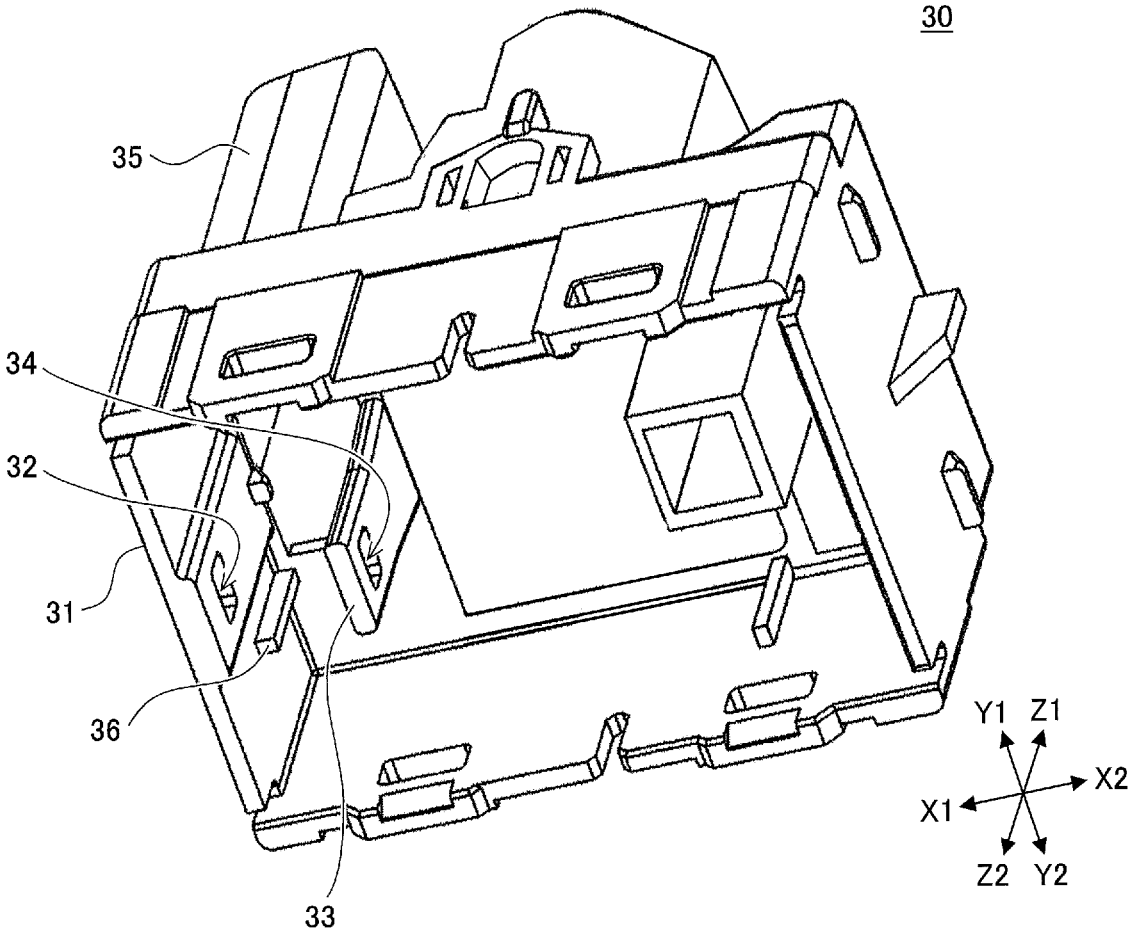
FIG. 7 is a perspective view (2) of the upper housing according to the embodiment.
Figure 8:
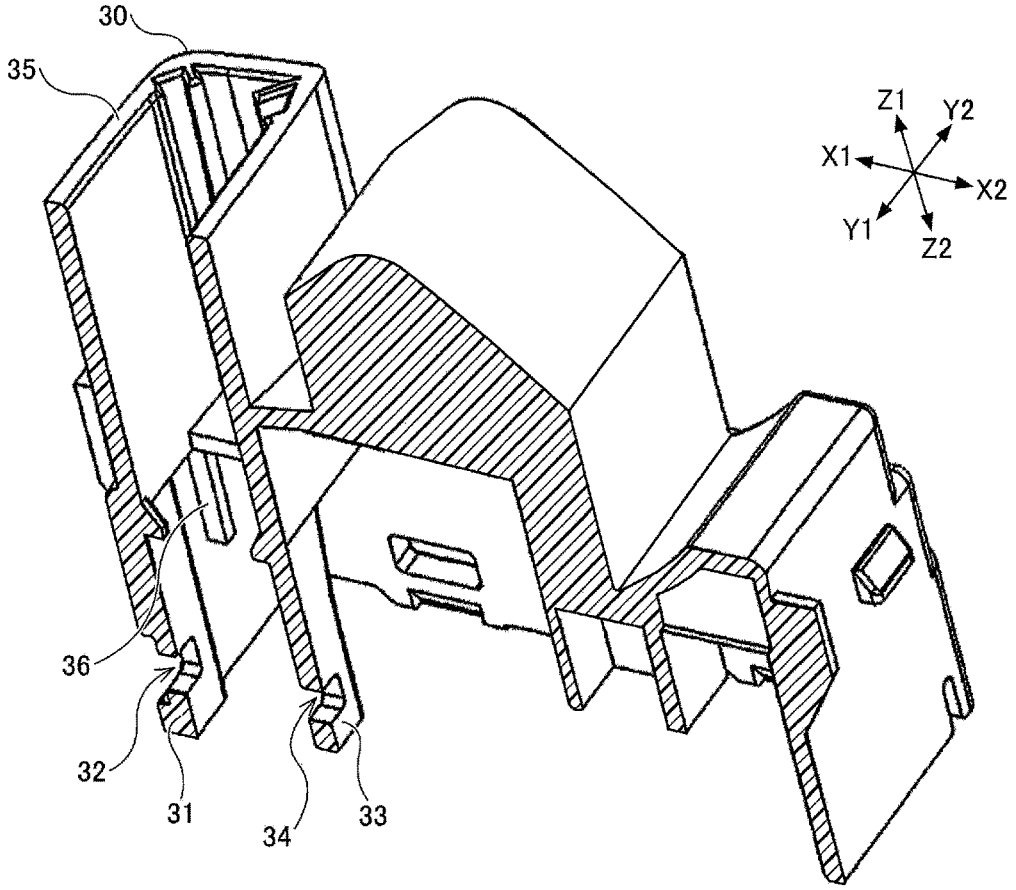
FIG. 8 is a cross-sectional perspective view of the upper housing according to the embodiment.

Next, the upper housing 30 will be described with reference to FIG. 6 through FIG. 8. FIG. 6 is a perspective view of the upper housing 30 as viewed from the top. FIG. 7 is a perspective view of the upper housing 30 as viewed from the bottom. FIG. 8 is a cross-sectional perspective view of the upper housing 30. The upper housing 30 is formed of a resin material, and has a box shape such that the substrate 20 can be placed within the upper housing 30. Further, a wall portion 31 that extends toward the Z2 side is formed on the X1 side of the upper housing 30. The wall portion 31 has a first insertion hole 32 (an example of an opening) through which the pin member 50 is inserted. The first insertion hole 32 may be an opening formed by cutting out an end portion on the Z2 side of the wall portion 31, as long as the pin member 50 can be inserted into the interior of the upper housing 30 (from the X1 side). Further, a support plate portion 33 that extends toward the Z2 side is disposed within the upper housing 30. That is, the support plate portion 33 that extends toward the lower housing 40 is disposed within the upper housing 30. The support plate portion 33 has a second insertion hole 34 on the Z2 side thereof, and the pin member 50 is inserted into the second insertion hole 34. Further, the upper housing 30 includes a box-shaped portion 35 that extends in the Z1-Z2 direction and in which the slider 70 is placed. Further, a positioning portion 36 that positions the substrate 20 is provided on the inner surface of the wall portion 31 that is located on the X1 side of the upper housing 30.

Figure 9:
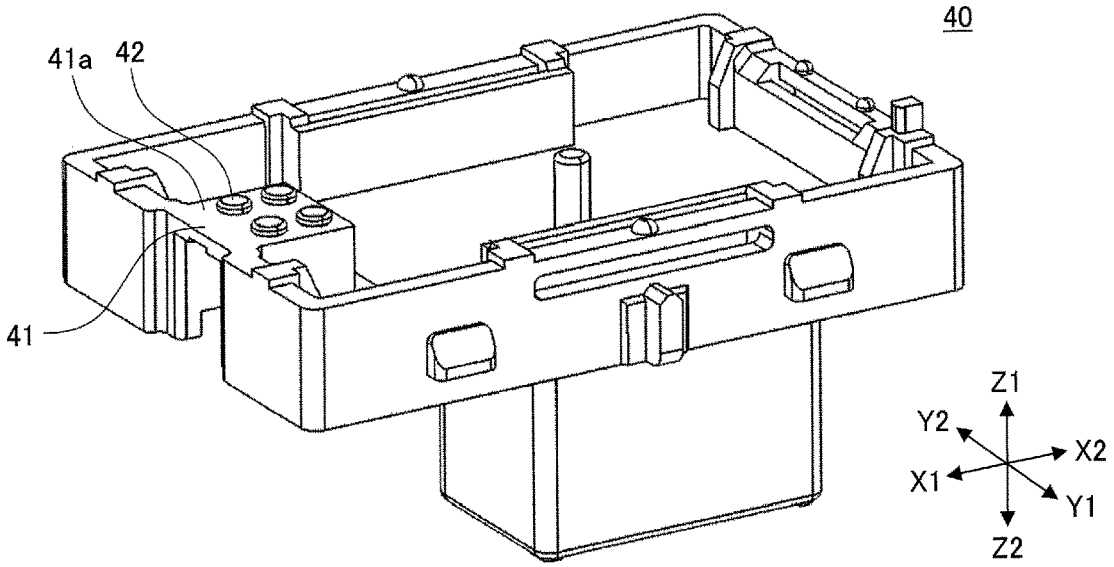
FIG. 9 is a perspective view of a lower housing according to the embodiment.
Figure 10:
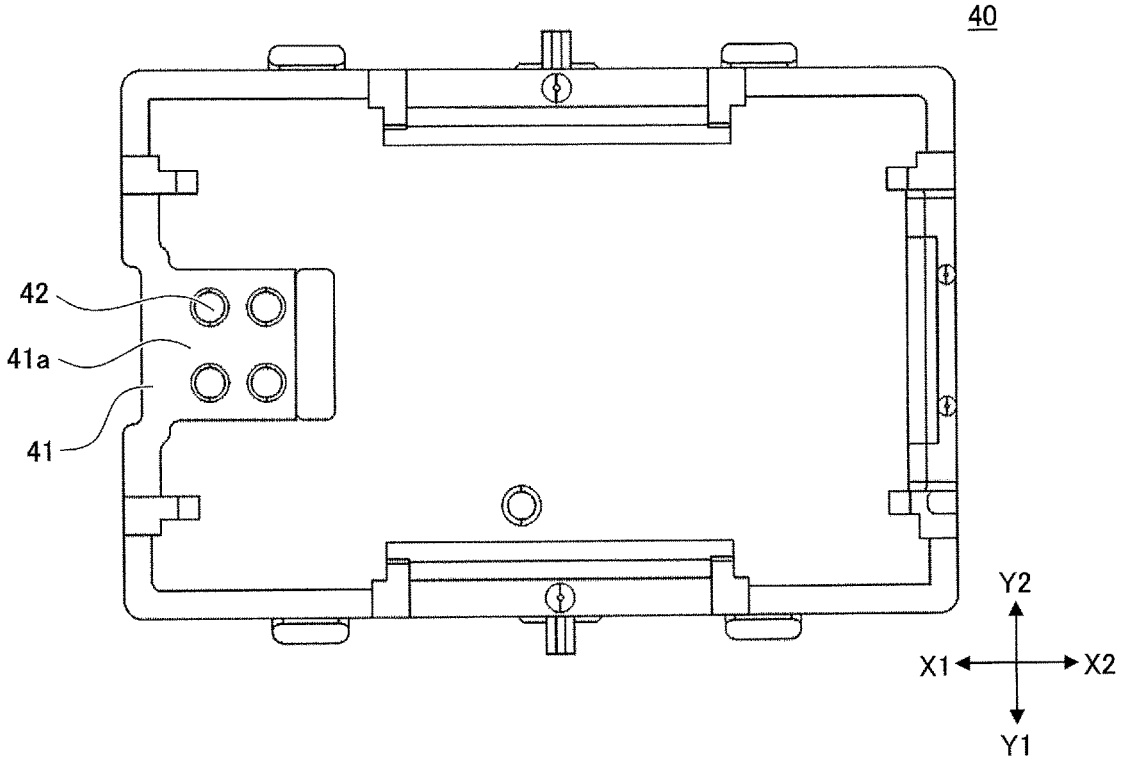
FIG. 10 is a top view of the lower housing according to the embodiment.
Figure 11:
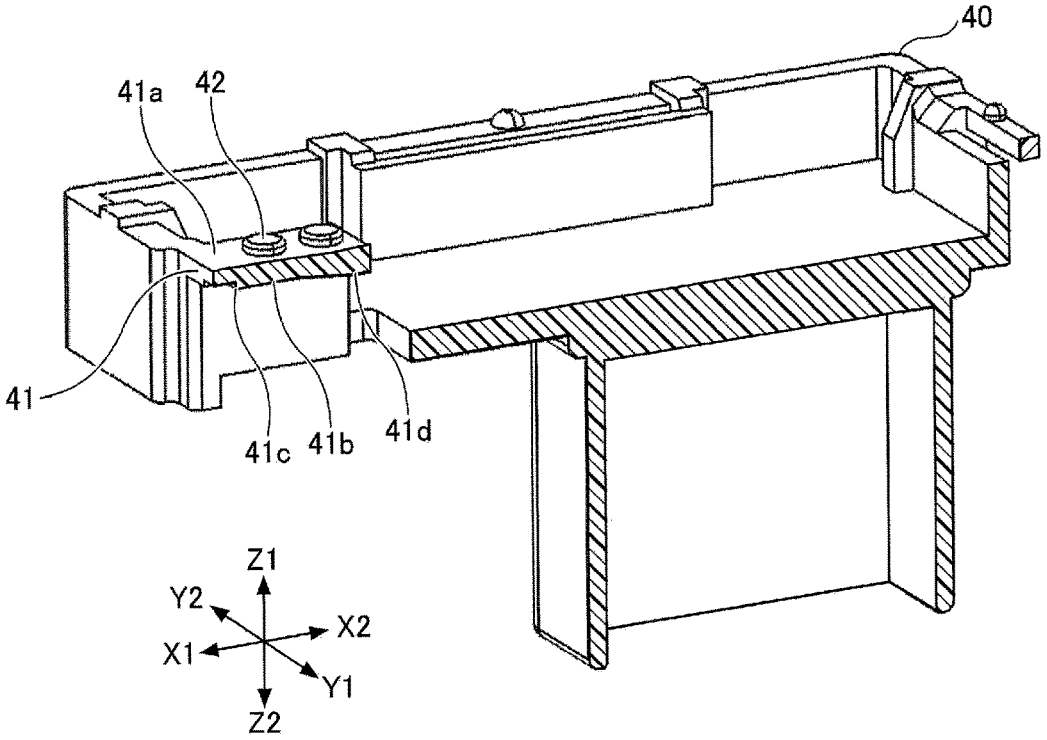
FIG. 11 is a cross-sectional perspective view of the lower housing according to the embodiment.

Next, a lower housing 40 will be described with reference to FIG. 9 through FIG. 11. FIG. 9 is a perspective view of the lower housing 40 as viewed from the top. FIG. 10 is a top view of the lower housing 40. FIG. 11 is a cross-sectional perspective view of the lower housing 40. The lower housing 40 is formed of a resin material. A support portion 41 that supports the substrate 20 from the Z2 side is formed on the X1 side of the lower housing 40. A first surface 41*a* facing the substrate 20 is formed on the Z1 side of the support portion 41, and a plurality of projections 42 are formed on the Z1 side of the first surface 41*a*. Each of the projections 42 has a cylindrical shape, a diameter of 2 mm, and a height of 0.5 mm. In the present embodiment, the number of the projections 42 is four. The tips of the projections 42 contact the surface on the Z2 side of the substrate 20 and support the substrate 20. With this configuration in which the projections 42 are used to support the substrate 20, the position and magnitude of the force applied to support the substrate 20 can be readily adjusted. The tips of the projections 42 may be rounded or chamfered. Accordingly, even in a case of the projections 42 and the substrate 20 both being formed of rigid materials such as resin materials, portions of the projections 42 that contact the substrate 20 will not be easily damaged. Note that the upper housing 30 and the lower housing 40 constitute a housing of the switch device according to the present embodiment.

In the present embodiment, as illustrated in FIG. 11, the thickness on the X2 side (inner side) of the support portion 41 of the lower housing 40 is greater than that on the X1 side (outer side) of the support portion 41. That is, the distance between the first surface 41*a* and a second surface 41*b* of the support portion 41 is greater on the X2 side than on the X1 side of the support portion 41. More specifically, the thickness on an outer side 41*c* (X1 side) of the support portion 41 is 1 mm, and the thickness on an inner side 41*d* (X2 side) of the support portion 41 is 1.25 mm. The inner side 41*d* is located inward relative to the outer side 41*c*, and the thickness of the support portion 41 gradually increases from the outer side 41*c* toward the inner side 41*d*. The first surface 41*a* of the support portion 41 is formed as a level surface.

Figure 12:
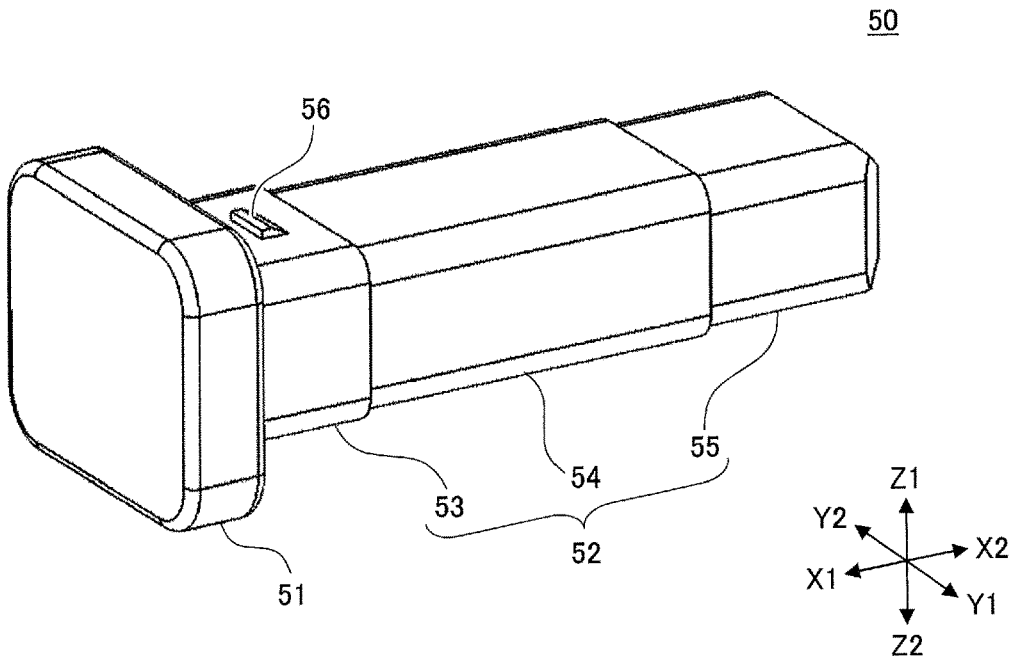
FIG. 12 is a perspective view of a pin member according to the embodiment.
Figure 13:
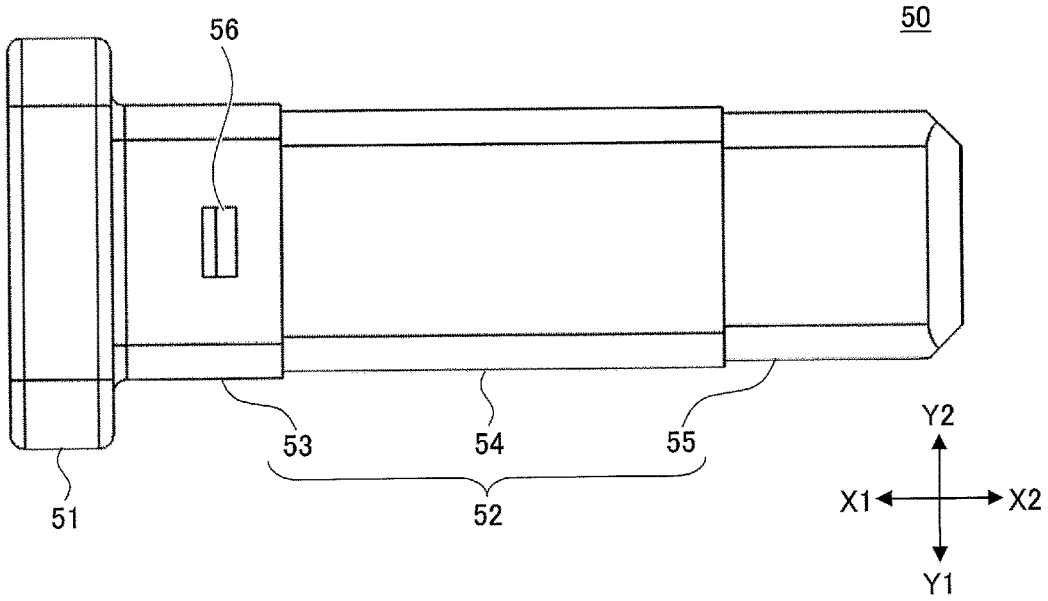
FIG. 13 is a top view of the pin member according to the embodiment.
Figure 14:
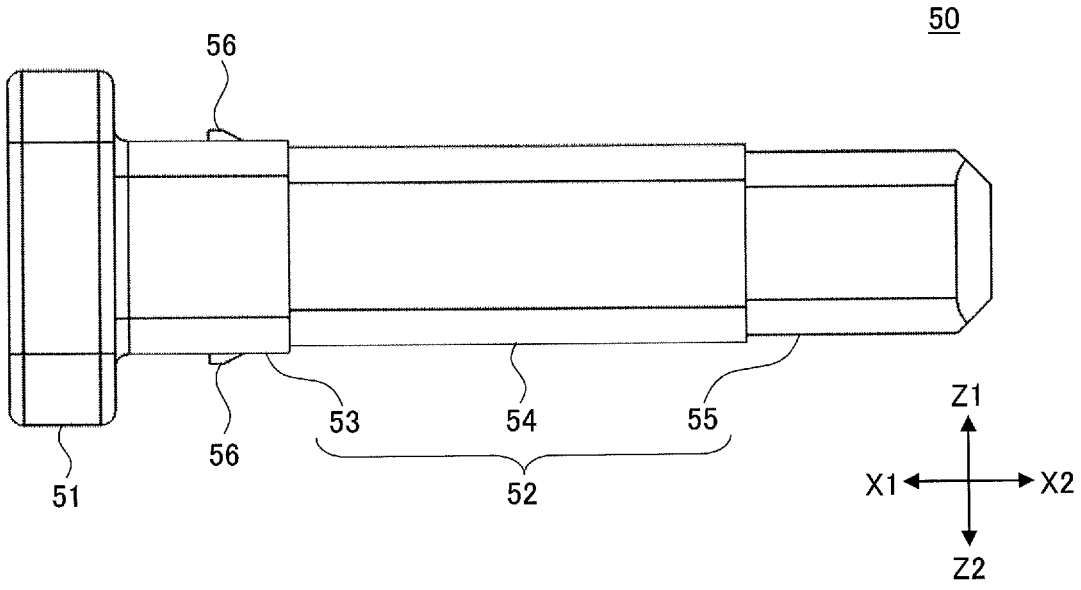
FIG. 14 is a side view of the pin member according to the embodiment.

Next, the pin member 50 will be described with reference to FIG. 12 through FIG. 14. FIG. 12 is a perspective view of the pin member 50. FIG. 13 is a top view of the pin member 50. FIG. 14 is a side view of the pin member 50. The pin member 50 is formed of a resin material or the like. As illustrated in FIG. 12 through FIG. 14, the pin member 50 includes a head portion 51 on the X1 side and a body portion 52 on the X2 side. The head portion 51 and the body portion 52 are formed such that a cross-section in the ZX-plane has an approximately rectangular shape. The length in the Z1-Z2 direction of the head portion 51 is approximately 5 mm. The X1 side of the body portion 52 is connected to the head portion 51, and the body portion 52 includes a first body portion 53, a second body portion 54, and a third body portion 55 in this order from the X1 side to the X2 side. The length in the Z1-Z2 direction of the first body portion 53 is approximately 3 mm, the length in the Z1-Z2 direction of the second body portion 54 is approximately 2.8 mm, and the length in the Z1-Z2 direction of the third body portion 55 is approximately 2.6 mm. Accordingly, the height of the surface on the Z1 side of the body portion 52 is formed, such that the second body portion 54 is lower than the first body portion 53 and the third body portion 55 is lower than the second body portion 54 in the Z1-Z2 direction. Further, protrusions 56 are formed on the respective surfaces on the Z1 side and Z2 side of the first body portion 53. Each of the protrusions 56 has a length of 0.15 mm to 0.2 mm, for example. As used herein, the first body portion 53 may be referred to as a body portion on the side closer to the head portion, and the third body portion 55 may be referred to as a body portion on the side closer to the tip of the pin member 50.

(Configuration of Switch Device)

Figure 15:
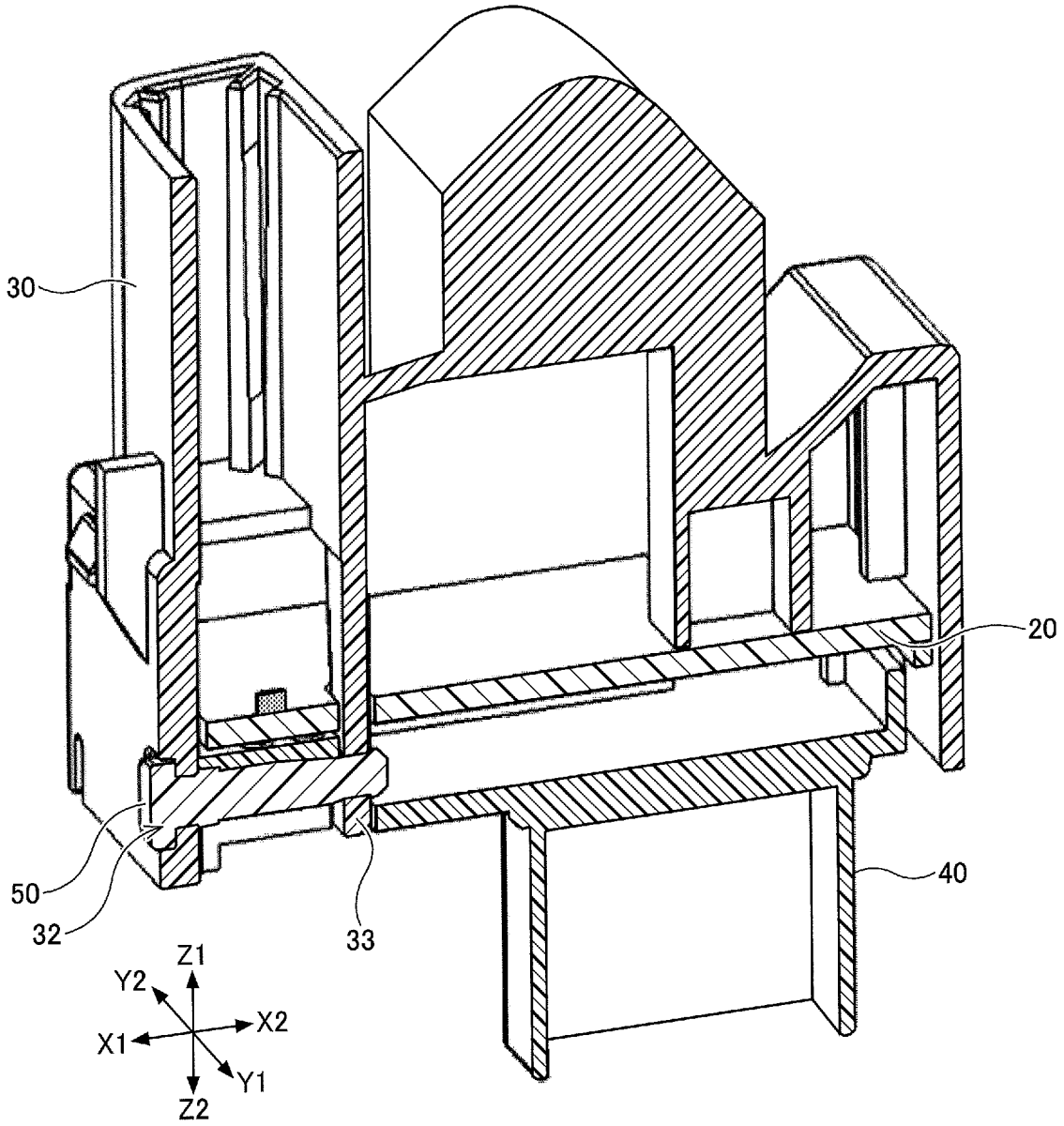
FIG. 15 is a diagram (1) illustrating the switch device according to the embodiment.
Figure 18:
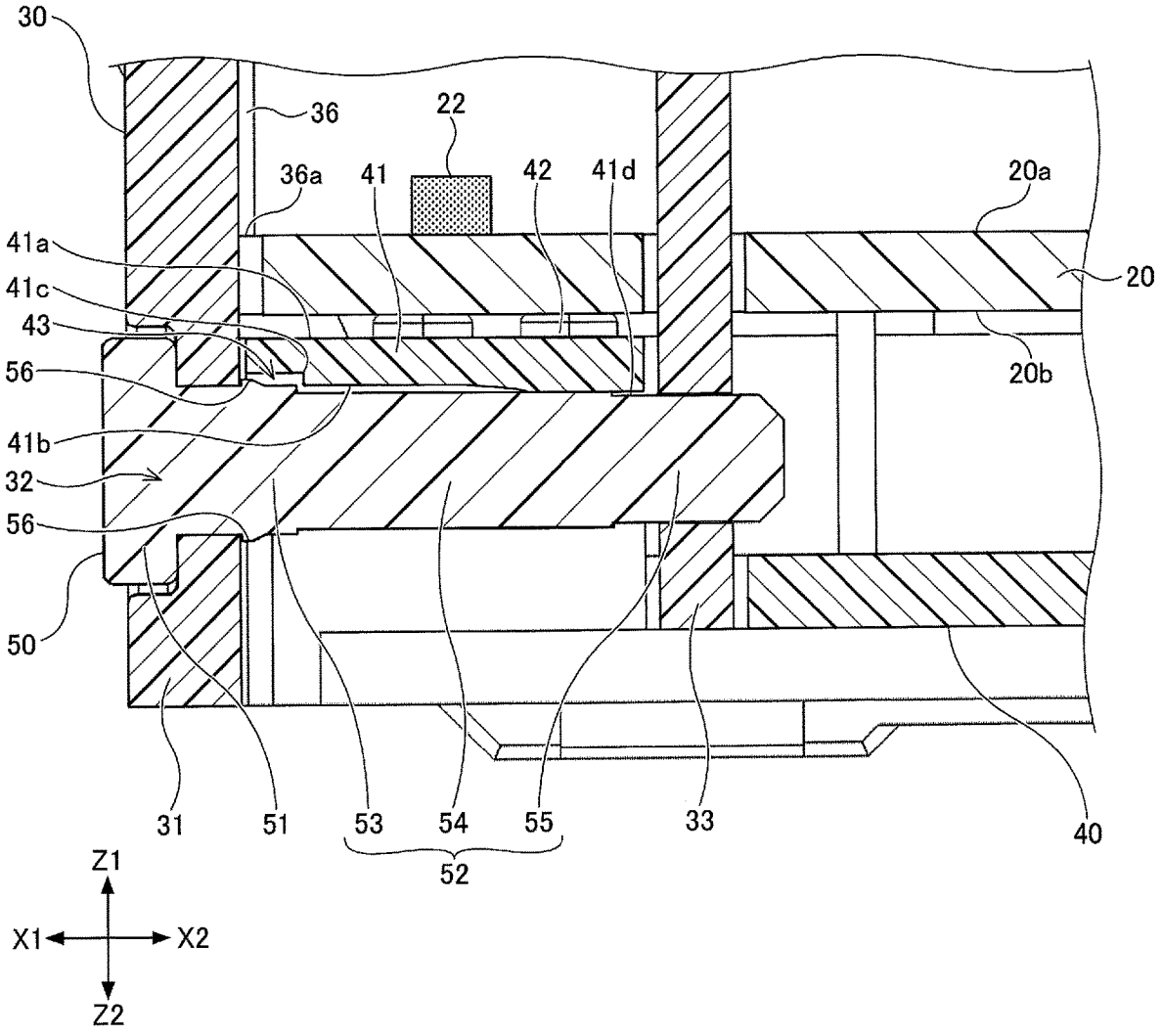
FIG. 18 is a diagram (4) illustrating the switch device according to the embodiment.
Figure 19:
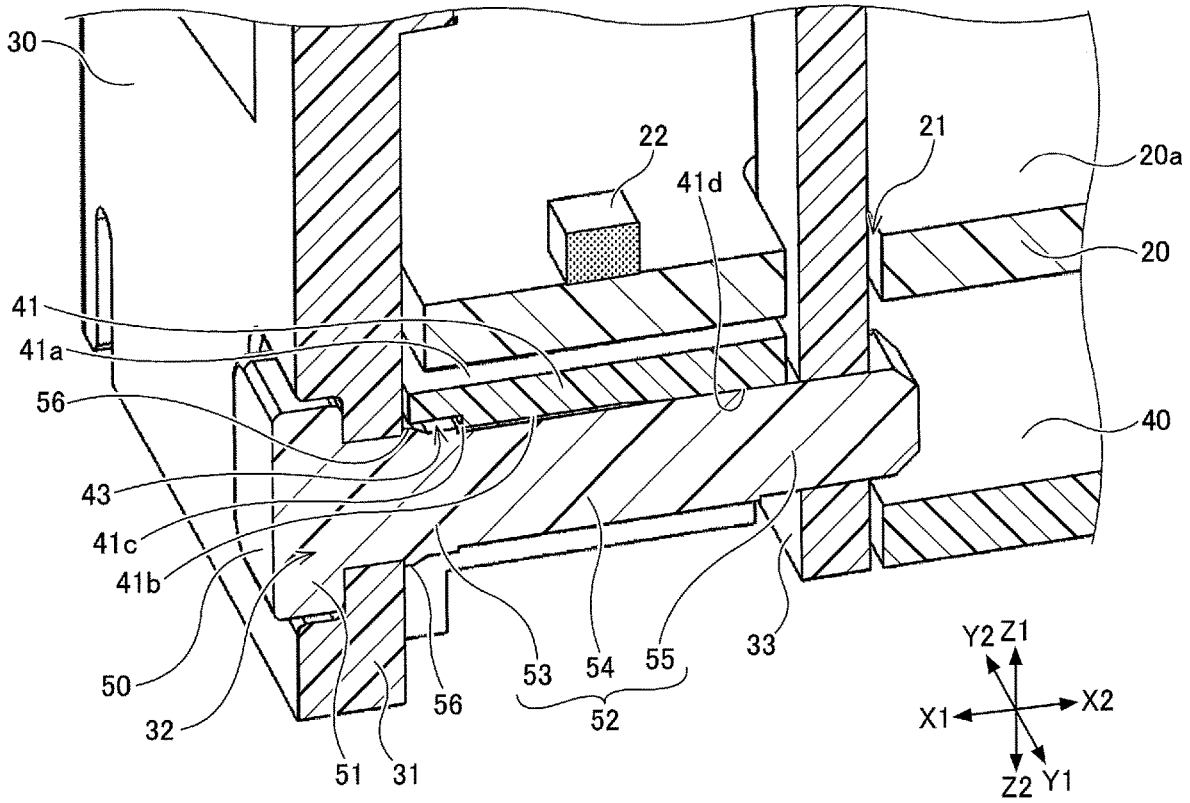
FIG. 19 is a diagram (5) illustrating the switch device according to the embodiment.
Figure 20:
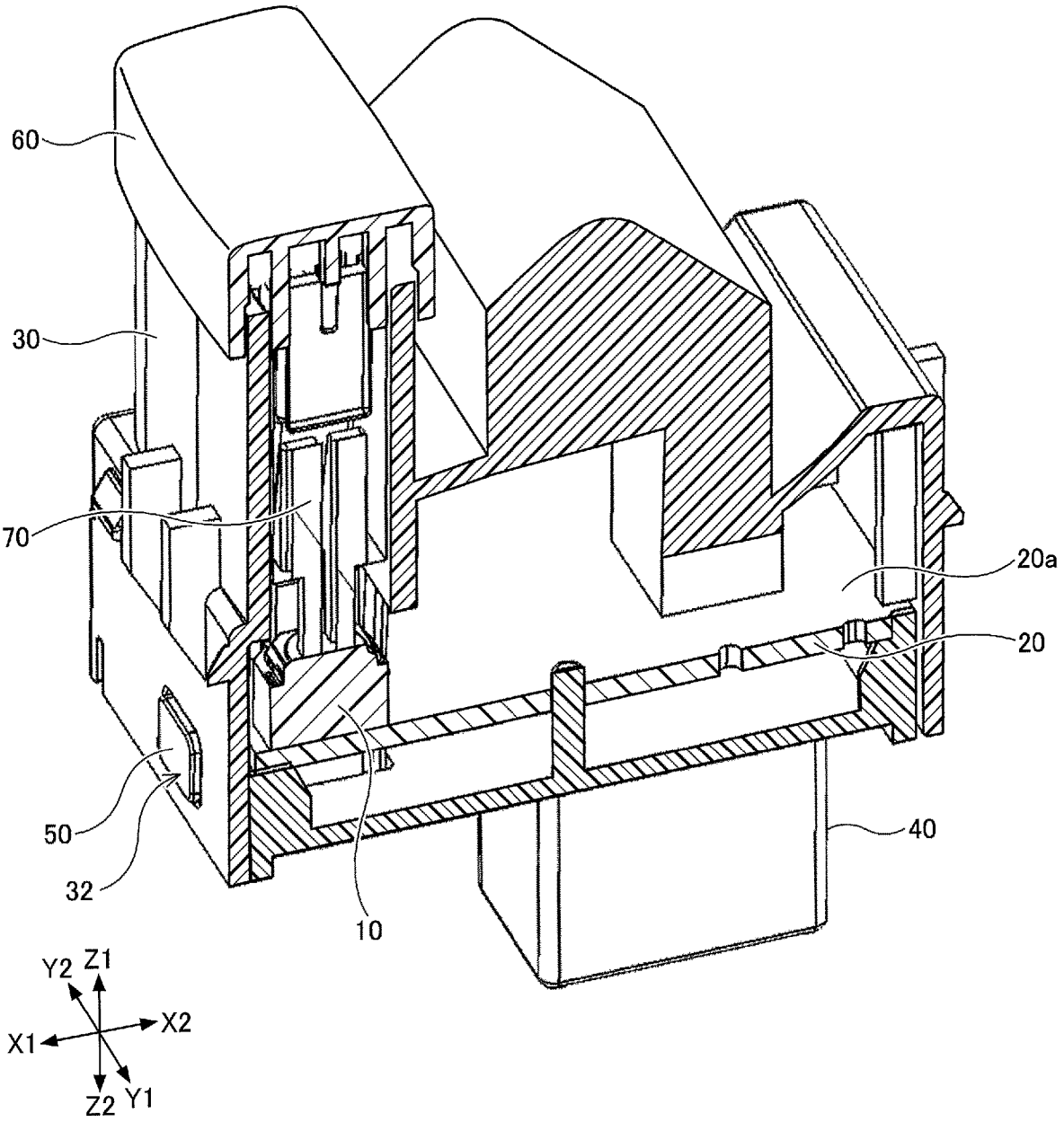
FIG. 20 is a cross-sectional perspective view (1) of the switch device according to the embodiment.

Next, a configuration of the switch device according to the present embodiment will be described. As illustrated in FIG. 15, in the switch device according to the present embodiment, the substrate 20 is sandwiched and fixed between the upper housing 30, located on the Z1 side of the substrate 20, and the lower housing 40 located on the Z2 side of the substrate 20. As illustrated in FIG. 20, the first insertion hole 32 is formed in the vicinity of the push-button switch 10, and the pin member 50 is inserted through the first insertion hole 32. Further, as illustrated in FIG. 18 and FIG. 19, the pin member 50, inserted through the first insertion hole 32, preloads the support portion 41 toward the upper housing 30 side (the Z1 side). Accordingly, a portion of the substrate 20 in the vicinity of the push-button switch 10 is preloaded toward the upper housing 30 side (the Z1 side) and is pressed by the positioning portion 36. As a result, the substrate 20 is accurately positioned in the Z-axis direction. In the present embodiment, snap-in components are provided on the outer peripheries of the upper housing 30 and the lower housing 40, thereby allowing the upper housing 30, the lower housing 40, and the substrate 20 to be fixed. Further, when the pin member 50 is inserted through the first insertion hole 32, the substrate 20 is preloaded toward the Z1 side.

Figure 16:
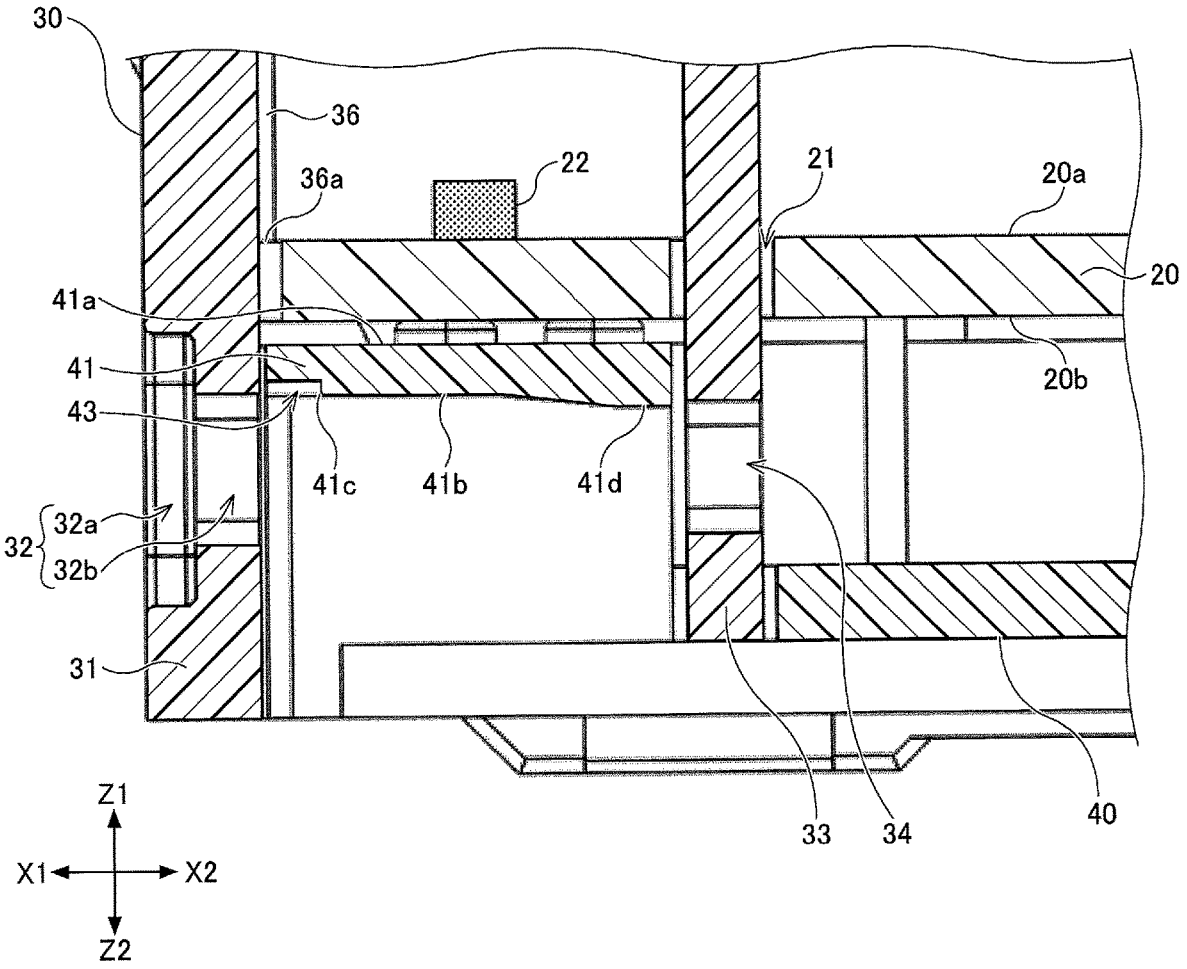
FIG. 16 is a diagram (2) illustrating the switch device according to the embodiment.
Figure 17:
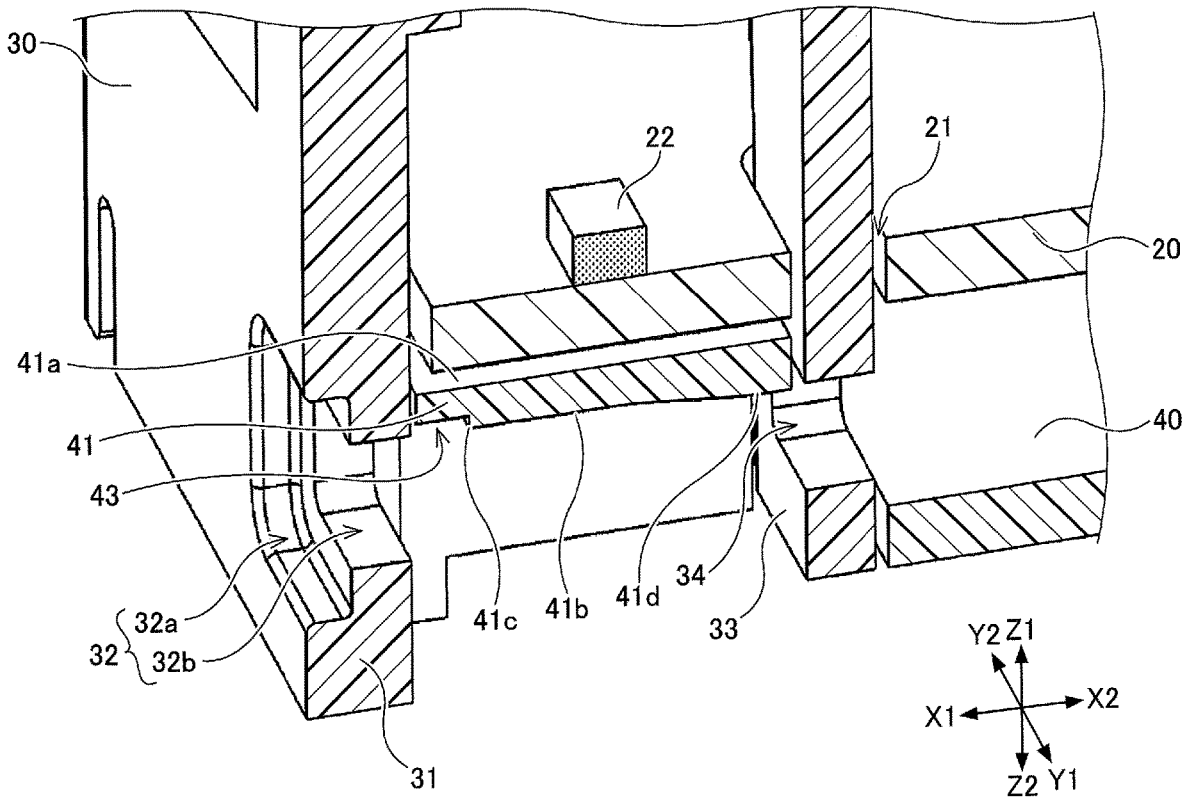
FIG. 17 is a diagram (3) illustrating the switch device according to the embodiment.

More specifically, as illustrated in FIG. 16 and FIG. 17, the substrate 20 is placed on the lower housing 40 such that the other surface 20*b* of the substrate 20 faces the surface on the Z1 side of the lower housing 40, and the substrate 20 is then covered by the upper housing 30. The support plate portion 33 of the upper housing 30 passes through the through-hole 21 and is disposed through the substrate 20. In this state, the tip on the Z2 side of the support plate portion 33 and the second insertion hole 34 are located on the X2 side relative to the support portion 41 of the lower housing 40. Accordingly, an internal space is formed on the Z2 side relative to the second surface 41*b* of the support portion 41 of the lower housing 40, and the pin member 50 is inserted into the internal space through the first insertion hole 32 and the second insertion hole 34 of the upper housing 30. The internal space into which the pin member 50 is inserted is a part of the internal space that is surrounded by the upper housing 30 and the lower housing 40 and in which the substrate 20 is disposed. FIG. 16 is a cross-sectional view of the switch device in which the pin member 50 is not inserted. FIG. 17 is a cross-sectional perspective of the switch device in which the pin member 50 is not inserted. The first insertion hole 32 of the upper housing 30 has a broader hole 32*a* on the X1 side and a support hole 32*b* on the X2 side. The shape of the broader hole 32*a* corresponds to the shape of the head portion 51 of the pin member 50. Further, a notch portion 43 is formed on the X1 side of the second surface 41*b* of the support portion 41 of the lower housing 40. The shape of the notch portion 43 corresponds to the shape of the protrusions 56 of the pin member 50.

In the state illustrated in FIG. 16 and FIG. 17, the pin member 50 is inserted into the internal space through the first insertion hole 32 and the second insertion hole 34 of the upper housing 30 from the third body portion 55 side thereof, as illustrated in FIG. 18 and FIG. 19. FIG. 18 is a cross-sectional view of the switch device in which the pin member 50 is inserted. FIG. 19 is a cross-sectional perspective view of the switch device in which the pin member 50 is inserted. Specifically, when the pin member 50 is gradually inserted into the first insertion hole 32 of the upper housing 30 from the third body portion 55 side in the X2 direction (insertion direction), the surface on the Z1 side of the body portion 52 of the pin member 50 contacts the second surface 41*b* of the support portion 41 of the lower housing 40. The support portion 41 is formed such that the thickness on the inner side (X2 side), which is further from the first insertion hole 32, of the support portion 41 is greater than the thickness on the outer side (X1 side), which is closer to the first insertion hole 32, of the support portion 41. Accordingly, when the pin member 50 is inserted in the X2 direction, the surface on the Z1 side of the body portion 52 of the pin member 50 presses the second surface 41*b* of the support portion 41 of the lower housing 40, thereby causing the support portion 41 to deform and the X2 side of the support portion 41 to be lifted in the Z1 direction. In this state, the first body portion 53 of the pin member 50 is located in the vicinity of the wall portion 31 of the upper housing 30, and the third body portion 55 of the pin member 50 is located inward relative to the first body portion 53.

The substrate 20 is disposed on the Z1 side of the support portion 41, and the substrate 20 is pressed by the projections 42 formed on the Z1 side of the support portion 41. When the pin member 50 is further inserted in the X2 direction, the third body portion 55 of the pin member 50 enters the second insertion hole 34, and the protrusions 56 formed on the first body portion 53 reach the inner side relative to the wall portion 31. As described, because the protrusions 56 formed on the first body portion 53 of the pin member 50 reach the inner side relative to the wall portion 31, the protrusions 56 of the pin member 50 can serve as stoppers. Accordingly, the pin member 50 does not readily come out of the first insertion hole 32, and the pin member 50 remains inserted in the first insertion hole 32.

Further, the positioning portion 36 is provided on the inner surface of the wall portion 31 that is located on the X1 side of the upper housing 30. Therefore, the one surface 20*a* of the substrate 20 contacts an end portion 36*a* on the Z2 side of the positioning portion 36. Accordingly, the substrate 20 is sandwiched between the end portion 36*a* of the positioning portion 36 and the projections 42 of the support portion 41 from both the surfaces 20*a* and 20*b* thereof, thus allowing the substrate 20 to be positioned and fixed at a predetermined position.

In the above-described state, a protrusion 56 formed on the pin member 50 enters the notch portion 43 formed on the second surface 41*b* of the support portion 41 of the lower housing 40, the head portion 51 of the pin member 50 is inserted into the broader hole 32*a* of the first insertion hole 32, and the first body portion 53 of the pin member 50 is inserted into the support hole 32*b* of the first insertion hole 32. Accordingly, at least a part of the pin member 50 is inserted into the internal space, formed by the upper housing 30 and the lower housing 40, through the first insertion hole 32 (in the X2 direction), and a part of the head portion 51 projects from the first insertion hole 32 to the outside (in the X1 direction).

As illustrated in FIG. 20, in the switch device according to the present embodiment, the portion of the substrate 20 in the vicinity of the push-button switch 10 is fixed at the predetermined position between the upper housing 30 and the lower housing 40 by the pin member 50. When the operator presses the pressing member 60 in the Z2 direction, the entire slider 70 is moved in the Z2 direction by the pressing force, thereby causing the end portion on the Z2 side of the slider 70 to press the pressing portion 11 of the push-button switch 10 in the Z2 direction. At this time, if an excessive pressing force is transmitted to the substrate 20, the substrate 20 would not be significantly deflected because the substrate 20 is pressed in the Z1 direction and fixed between the upper housing 30 and the lower housing 40. Accordingly, the possibility that the push-button switch 10 and the pressing portion 11 may be moved from a fixed position becomes sufficiently small. Thus, the operator of the pressing member 60 can securely turn the push-button switch 10 on.

In the above-described embodiment, the thickness of the support portion 41 gradually increases from the outer side 41*c* to the inner side 41*d* thereof. However, the thickness of the support portion 41 is not required to gradually increase, and one or more portions, facing the pin member 50, of the support portion 41 may increase in thickness. In addition, in the above-described embodiment, the pin member 50 is formed such that the height of the surface on the Z1 side of the body portion 52 decreases toward the tip side (X2 side) thereof. However, the height of the surface on the Z1 side of the body portion 52 may be uniform. Effects similar to the above can be obtained in this case as well.

Figure 21:
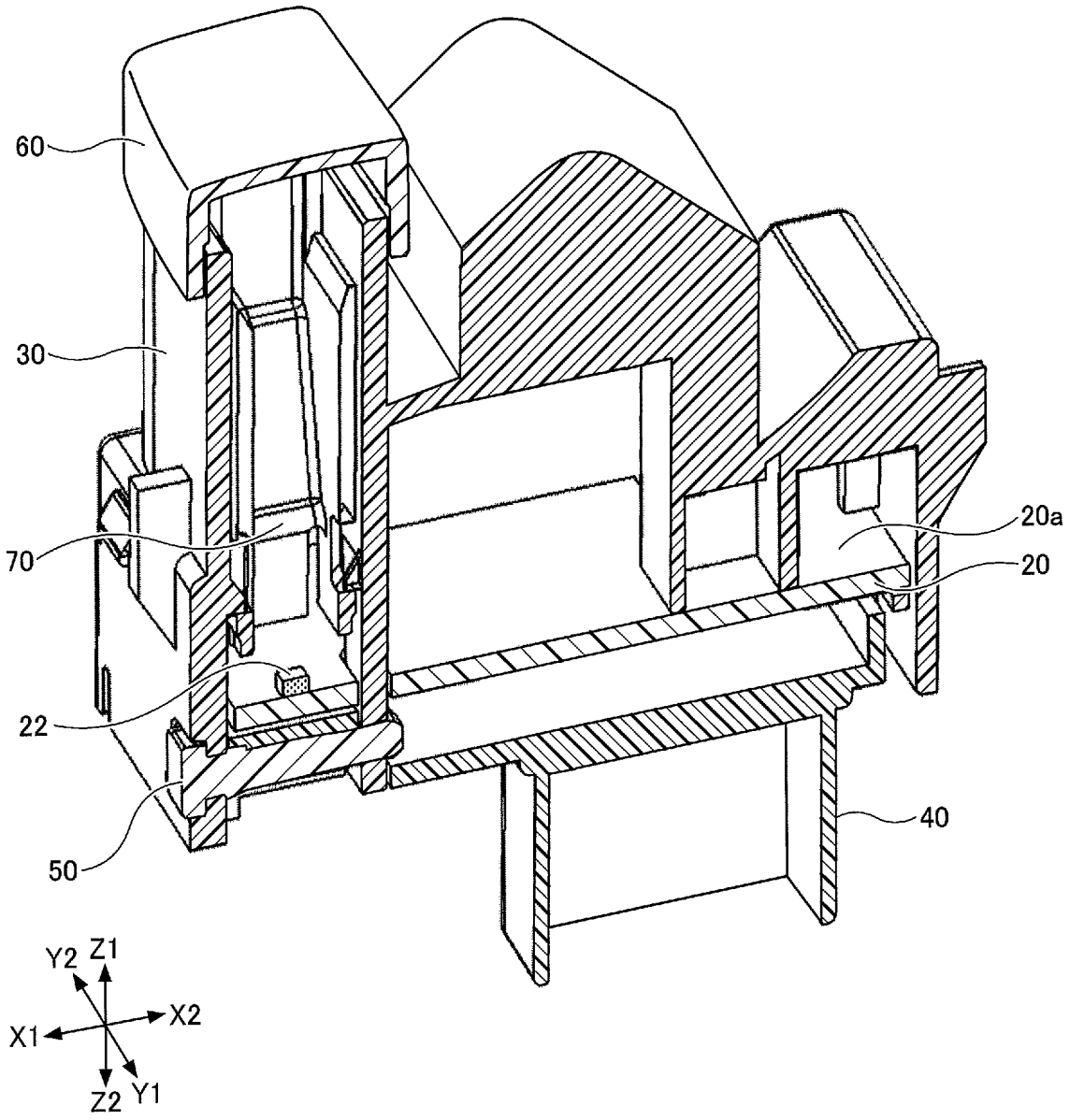
FIG. 21 is a cross-sectional perspective view (2) of the switch device according to the embodiment.

Further, in the switch device according to the present embodiment, the light emitting element 22 may be attached to the one surface 20*a* of the substrate 20 as illustrated in FIG. 21, and the slider 70 may be hollow. In addition, a portion of the pressing member 60 where characters are to be displayed may be formed of a transparent material. In this case, light emitted from the light emitting element 22 passes through the inside of the slider 70, and is emitted from the transparent portion of the pressing member 60. Accordingly, the characters can be displayed by the light emitted from the light emitting element 22.

Although specific embodiments have been described above, the present invention is not limited to the particulars of the above-described embodiments. Variations and modifications may be made without departing from the scope of the subject matter recited in the claims.

What is claimed is:

1. A switch device comprising:

a substrate having one surface and another surface;

a switch disposed on the one surface of the substrate and configured to be pressed;

a first housing;

a second housing; and a pin member, wherein an internal space is formed by the first housing and the second housing, the substrate being disposed in the internal space, wherein the first housing has an opening through which at least a part of the pin member is inserted into the internal space, wherein the second housing includes a support portion that supports the another surface of the substrate, and wherein, when the pin member is inserted into the internal space through the opening, the pin member presses the support portion against the another surface of the substrate so as to cause the support portion to support the another surface of the substrate, wherein the first housing includes a support plate portion that extends toward the second housing, wherein the substrate has a through-hole, and wherein the support plate portion passes through the through-hole and is disposed through the substrate.

2. The switch device according to claim 1, wherein the support portion of the second housing has a first surface and a second surface, and wherein, when the pin member is inserted into the internal space through the opening, the pin member contacts and supports the second surface of the support portion so as to cause the first surface of the support portion to support the another surface of the substrate.

3. The switch device according to claim 1, wherein a thickness on an inner side of the support portion is greater than a thickness on an outer side of the support portion, the outer side being closer to the opening than the inner side.

4. The switch device according to claim 1, wherein a thickness on an inner side of the pin member is smaller than a thickness on an outer side of the pin member, the outer side being closer to the opening than the inner side.

5. The switch device according to claim 1, wherein the first housing includes a positioning portion, and wherein the support portion presses the another surface of the substrate so as to cause the one surface of the substrate to contact the positioning portion and to cause the substrate to be positioned.

6. The switch device according to claim 1, wherein the pin member includes a head portion and a body portion that is thinner than the head portion, and wherein the body portion of the pin member has a protrusion that maintains a state in which the body portion of the pin member is inserted into the internal space through the opening.

7. The switch device according to claim 1, wherein the support plate portion has an insertion hole into which the pin member is inserted, and wherein a body portion of the pin member presses the support portion in a state in which the body portion of the pin member is inserted into the opening and the insertion hole.

* * * * *